US005857730A

United States Patent [19]

Korpi et al.

[11] Patent Number: 5,857,730

[45] Date of Patent: Jan. 12, 1999

[54] LOW VISIBILITY ARMOR STRUCTURE WITH ADD-ON WINDOW ARMOR COMPONENT

[75] Inventors: John G. Korpi, Livonia; Paul A. Petrovich, Fowlerville; John J. Schmitz, St. Clair Shores; Jack G. Rodgers, Roseville; Kyle J. Nebel, Warren, all of Mich.

[73] Assignee: United Stated of America as represented by the Secretary of the Army, Washington, D.C.

[21] Appl. No.: 851,388

[22] Filed: May 5, 1997

[51] Int. Cl.[6] ..... B60J 1/08

[52] U.S. Cl. ..... 296/146.1; 296/146.1; 296/201; 296/146.2; 296/146.15; 296/96.21; 296/96.22; 89/36.08; 89/36.09; 89/36.07; 89/36.02; 109/49.5

[58] Field of Search ..... 296/146.1, 201, 296/146.2, 146.15, 96.21, 96.22; 89/36.08, 36.09, 36.07, 36.02; 109/49.5

[56] References Cited

U.S. PATENT DOCUMENTS

| | | | |
|---|---|---|---|
| 3,671,370 | 6/1972 | Littell, Jr. | 161/43 |
| 3,855,898 | 12/1974 | McDonald | 89/36 |
| 4,027,443 | 6/1977 | Briggs | 52/202 |
| 4,061,815 | 12/1977 | Poole, Jr. | 428/215 |
| 4,316,404 | 2/1982 | Medlin | 296/146.2 |
| 4,988,142 | 1/1991 | Chandler et al. | 296/146 |
| 5,370,035 | 12/1994 | Madden, Jr. | 89/36.02 |
| 5,413,026 | 5/1995 | Madden, Jr. | 89/36.02 |
| 5,594,193 | 1/1997 | Sheridan | 89/36.08 |
| 5,679,918 | 10/1997 | Korpi et al. | 109/49.5 |

FOREIGN PATENT DOCUMENTS

| | | | |
|---|---|---|---|
| 3639-781-C | 6/1988 | Germany | 296/201 |
| 4006-708-A | 9/1991 | Germany | 296/146.15 |

*Primary Examiner*—D. Glenn Dayoan
*Assistant Examiner*—Kiran Patel
*Attorney, Agent, or Firm*—Peter A. Taucher; David L. Kuhn

[57] ABSTRACT

A low visibility interior armor construction for a door of an automotive vehicle is removably installed in the vehicle without structural change to the vehicle. The construction has a door panel armor component facing an inboard side of the door and a compressible pad between the inboard side of the door and the armor component. The armor component has hooks by which it hangs on the door. The armor component is tightened to the door by tensionable straps connected between the door and the armor component. The construction also has a plate of window armor alongside the door's window frame and a transparent frame forms a channel about a periphery of the plate. The frame is comprised of continuous polygonal bands forming side walls of the channel. Beds of the channel are recessed between the polygonal bands such that the transparent frame defines a continuous surface facing outboard of the vehicle. A transparent flange connects the door armor component to the transparent frame. A bracket fixed to the transparent frame has a bracket flange which lies in a channel of the door's window frame, the bracket flange being inserted between a pane of door window glass and a portion of a gasket in the door window channel.

7 Claims, 3 Drawing Sheets

LOW VISIBILITY ARMOR STRUCTURE WITH ADD-ON WINDOW ARMOR COMPONENT

GOVERNMENT USE

The invention described here may be made, used and licensed by or for the U.S. Government for governmental purposes without paying us any royalty.

BACKGROUND AND SUMMARY

Our invention relates to interior armor for vehicles and relates particularly to vehicles that carry passengers. Many armored vehicles are standard production vehicles specially modified to accept armor panels. Such vehicles are typically changed so drastically that they can not be adapted for normal use, even if armor components are removed. Also, many armored cargo and passenger vehicles are conspicuous because of their unusual character. Yet for security reasons it is often better for an armored vehicle be hard to distinguish from normal vehicles.

Our invention is a low visibility interior armor construction that can be retrofitted onto production passenger vehicles and thereafter removed, leaving the vehicles in their original configuration. That is, the vehicles' components undergo no permanent deformation or structural change when the armor construction is installed or removed. Our interior armor construction is most typically used for a vehicle door but can be for other panels of an automotive vehicle.

Our armor construction modifies a pre-existing structure comprised of a door panel armor component facing an inboard side of the door and a compressible pad that lies between the inboard side of the door and the armor component. The armor component has hooks by which it hangs on the door. The armor component is tightened to the door by tensionable straps connected between the door and the armor component.

Our construction adds a plate of window armor opposed alongside the door's window frame, and adds a transparent frame which forms a peripheral channel about the plate. A transparent flange is connected between the transparent frame and the door armor component. The frame has continuous polygonal bands forming side walls of the peripheral channel. Beds of the channel are between the polygonal bands and are flush with the bands, so that the transparent frame defines a continuous surface facing outboard of the vehicle. A bracket fixed to the transparent frame has a bracket flange extending into the channel of the door's window frame, the bracket flange being inserted between a pane of door window glass and a portion of a gasket in the window channel.

DETAILED DESCRIPTION

Figure 1:
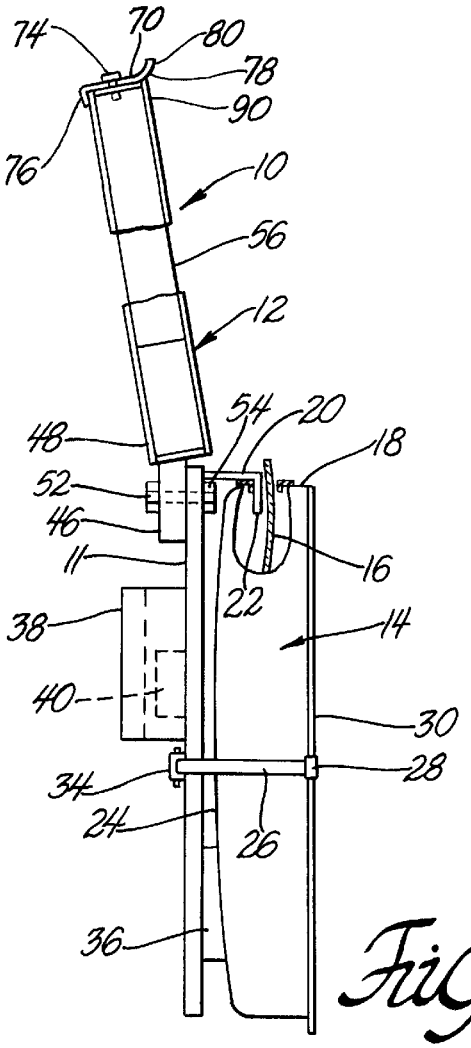
FIG. 1 is a partly sectioned end elevational view of a door having our armor construction thereon, the door's window frame being omitted from this view.
Figure 4:
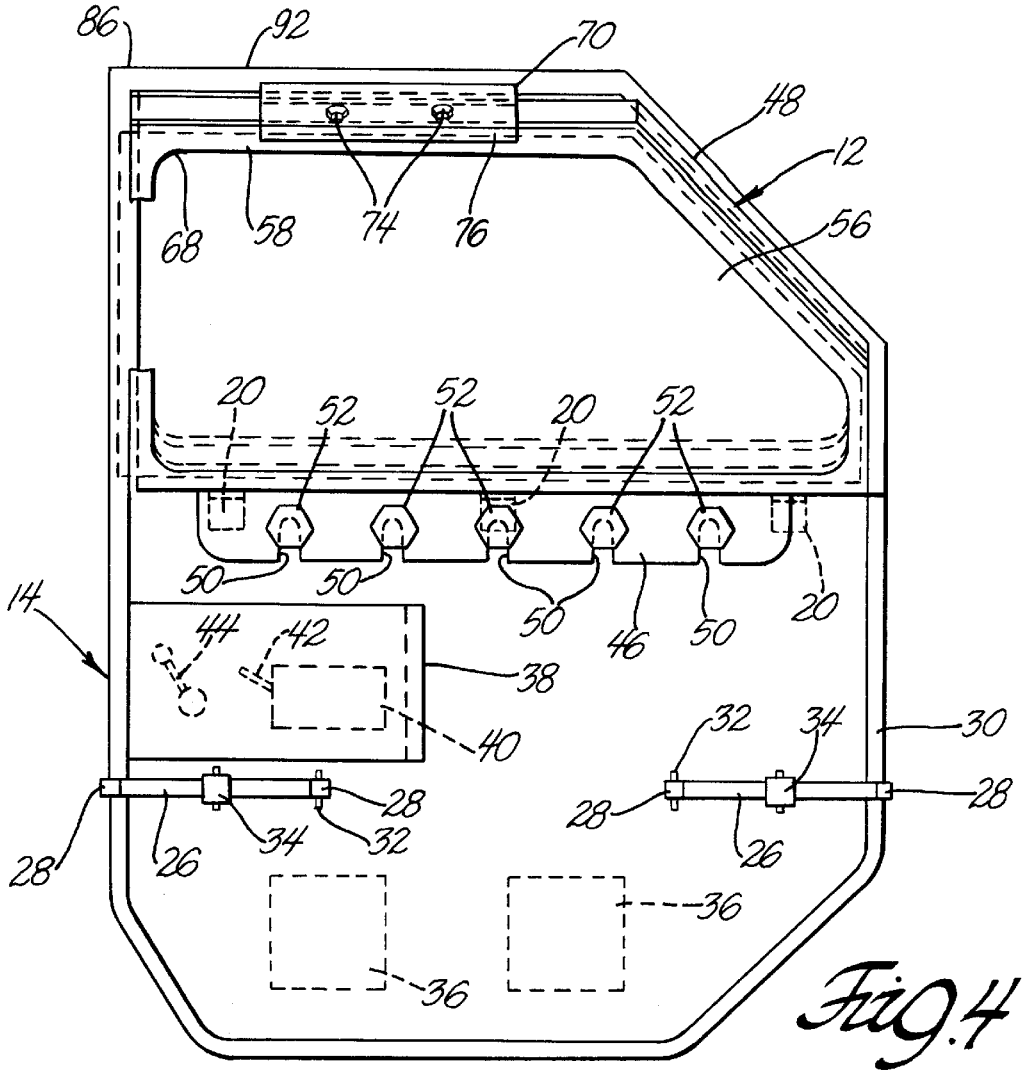
FIG. 4 is a side elevational view of the door and the door's window frame, the door and its window frame having our armor construction thereon.

As seen in FIGS. 1 and 4, our low visibility armor structure 10 is installed on a conventional door 14 of a commercial passenger vehicle (not shown), structure 10 having window armor component 12 and a door panel armor component 11. Door 14 has a window pane 16 that can be raised or lowered through an opening in the door's sill 18. Component 11 defines a well 38 which covers the door's arm rest 40, a door opening lever 42 (FIG. 4 only) and a window crank 44 (FIG. 4 only).

Extending from component 11 are hooks 20 whose free ends 22 (FIG. 1 only) fit into the sill opening. By means of hooks 20, door panel armor component 11 is removably mounted on door 14 such that component 11 hangs opposite the inboard side 24 of the door. Also holding component 11 to door 14 are straps 26. At the ends of straps 26 are hooks 28 which engage peripheral door flange 30 or one of anchors 32. The straps are provided with buckles 34 to adjust strap length and tension. The tension on straps 34 compresses elastomeric pads 36, which are disposed between component 11 and inboard door side 24.

We note here that component 11, hooks 20, straps 26, anchors 32, buckles 34 and pads 36 together form a design previously conceived by a different inventorship entity than we five inventors named in this application. However, we believe that we are the first to invent window armor component 12. We also believe we are the first to combine component 12 with component 11 and its associated hooks, straps, anchors, buckles and pads.

Figure 3:
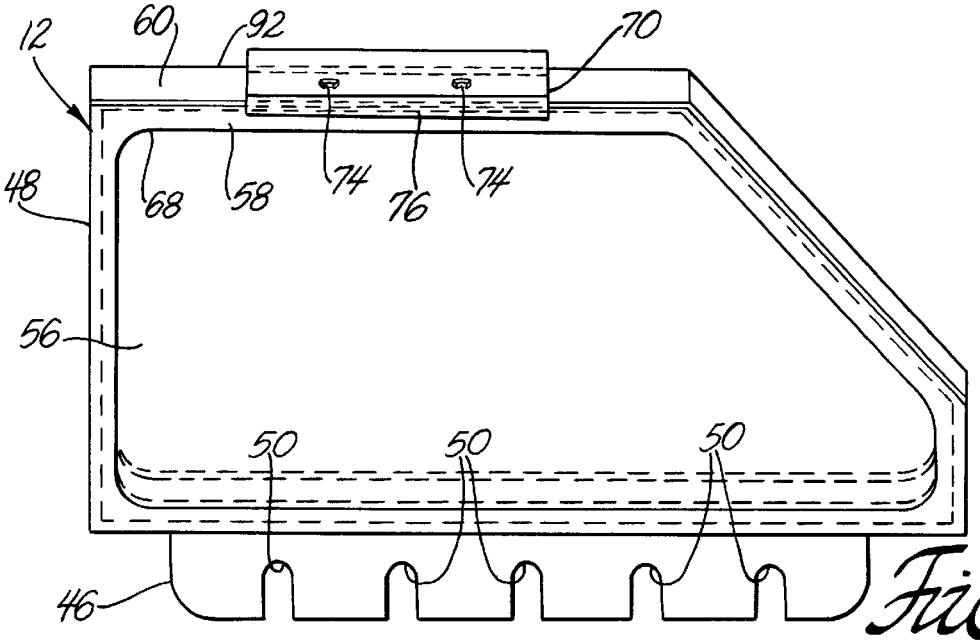
FIG. 3 is a side elevational view of a window armor component that forms part of our armor construction.

As seen in FIGS. 1 and 3, window armor component 12 has a transparent flange 46 forming an obtuse angle with transparent frame 48, the flange and frame being of polycarbonate material or other strong, clear material. Flange 46 can be fixed to frame by plastic welding or by the use of adhesives. Flange 46 defines a series of downward opening slots 50 accommodating bolts 52 that secure component 12 to component 11. Bolts 52 thread with nuts 54, which are preferably fixed to the outboard side component 11.

Figure 2:
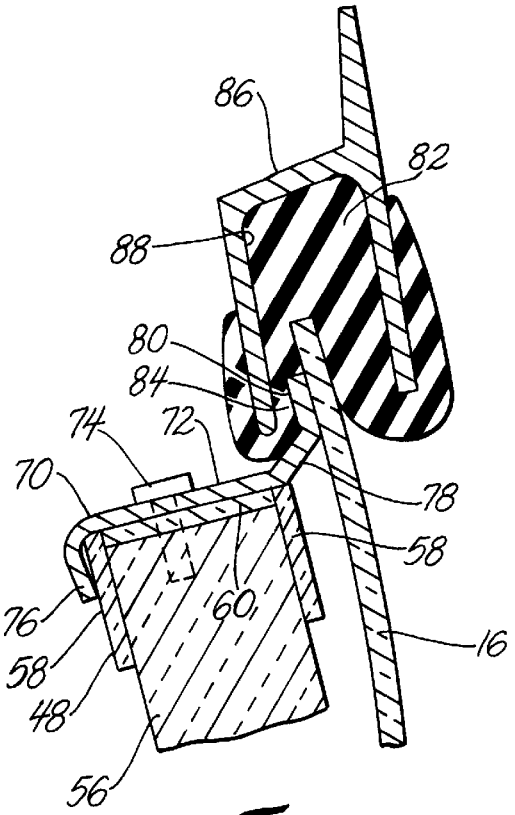
FIG. 2 is a detail sectional view showing the engagement between a frame of our armor construction and a channel in the upper window frame of a vehicle door.
Figure 6:
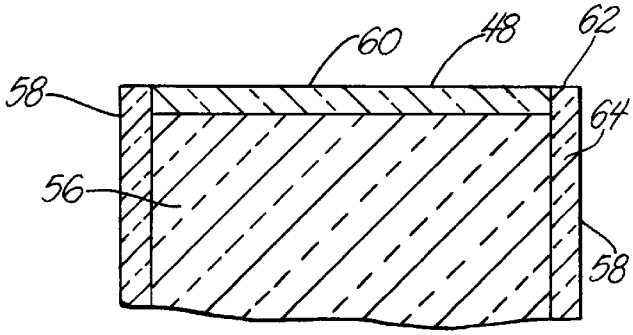
FIG. 6 is a cross sectional view of the preferred embodiment of the channel of the transparent frame.

Frame 48 is a peripheral channel that surrounds a plate 56 of clear window armor. The plate and frame 48 are disposed opposite and approximately parallel to the general plane defined by window frame 86 (FIGS. 2 and 4). The plate and frame are slightly spaced from that plane. The cross sectional shape of the channel is shown in FIG. 6. The channel's side walls 58 have therebetween a bed 60, which is flush or recessed with respect to those side walls. It is preferred that the beds do not face against edges of the side walls in the way that bed 60*a* faces on side walls 58*a* in FIG. 8. Side walls 58 are typically welded to bed 60 or else bonded to bed 60 with an adhesive. The advantage of the FIG. 6 configuration is that corner 62 has a smooth, continuous surface 64 facing outboard of the vehicle where frame 48 is installed.

Figure 8:
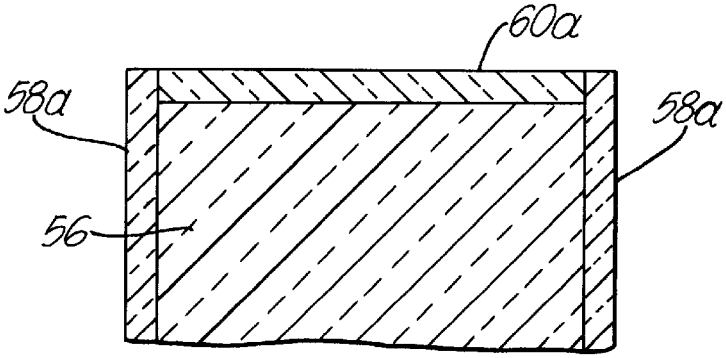
FIG. 8 is another cross sectional view of the channel of the transparent frame.

Consequently, corner 62, as well as the rest of frame 48, will withstand greater ballistic impacts from the outboard direction than will the FIG. 8 configuration.

Figure 5:
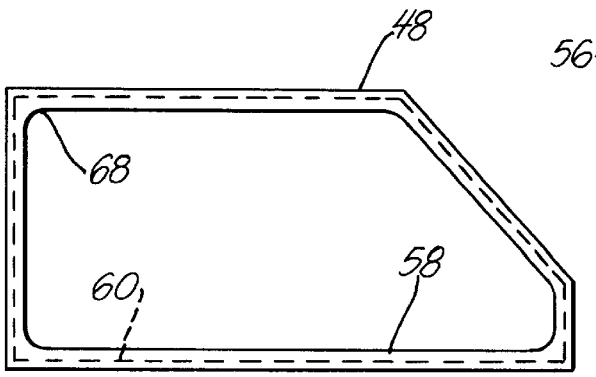
FIG. 5 is a side elevational view of a preferred configuration of the transparent frame of the window armor component of our armor construction.
Figure 7:
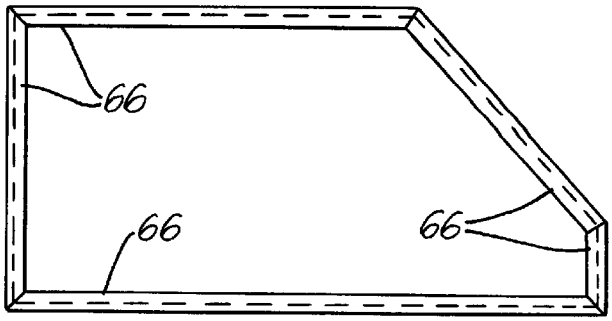
FIG. 7 is a side elevational view a frame of a window armor component where the side wall of a channel of the frame is not a unitary piece, but is comprised of side wall segments.

It will be noted that each side wall 58 is cut or suitably formed as a single, unitary piece that forms a continuous polygonal band or border as shown in FIG. 5. Preferably, the internal edge of side wall 58 has fillets at the corners to strengthen them, as at 68. The continuous polygonal band is preferred over a series of side wall segments 66 glued or otherwise bonded together to form a polygonal band as seen in FIG. 7. It is believed that the FIG. 5 side wall structure avoids potential structural and ballistic weak points such as those at junctures between segments 66.

Figure 9:
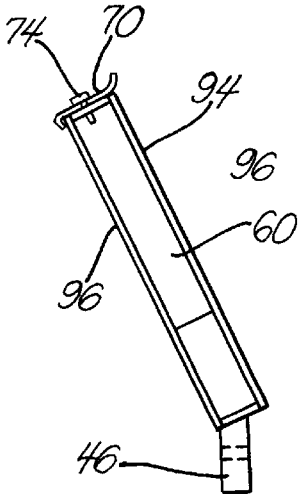
FIG. 9 is an end elevational view of an alternate embodiment of the window armor component.
Figure 10:
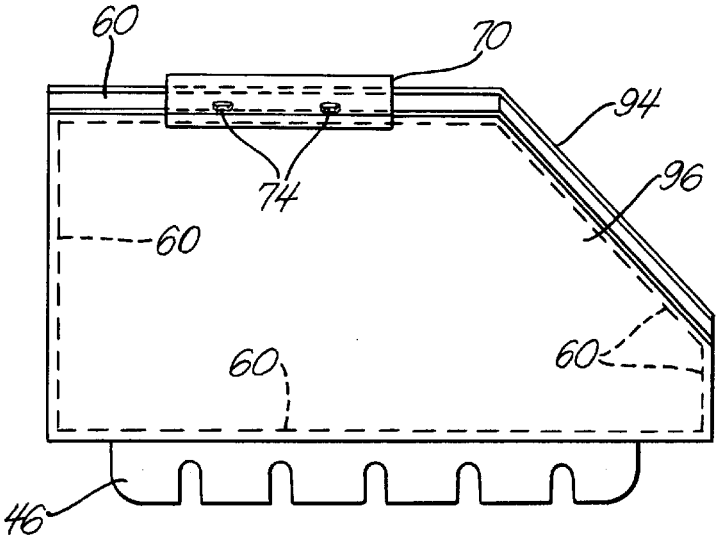
FIG. 10 is a side elevational view of the alternate embodiment of the window armor component.

As an option, the continuous polygonal bands that are side walls 58 can be replaced by unapertured polygonal sheets 96, which are part of frame 94 shown in FIGS. 9 and 10. It can be seen that frame 94 completely covers, or encapsulates, the plate of window armor so that the plate has no exposed surface. Flush with sheets 96 and located therebetween are beds 60, which are the same as beds 60 in FIG. 6 between sidewalls 58.

As best seen in FIG. 2, there is fastened atop frame 48 an elongate bracket 70 (FIG. 2) formed from a sheet of aluminum or other metal. Bracket 70 may also be made of the same clear polycarbonate material of which frame 48 is composed, and it may be preferred to make bracket 70 integral with frame 48. Bracket 70 is the means by which the top of window armor component 12 can be held on the door's window frame 86 without changing the structure of frame 86, door 14 or the vehicle of which the frame and door are part.

As seen in FIG. 2, bracket 70 has a mediate flat section 72 facially bearing on one of the frame's beds 60. A bolt 74 or similar threaded fastener at section 72 passes through section 72 into plate 56 and holds bracket 70 fixedly on frame 48. Bolt 74 may in some cases be made of a clear plastic material. Along mediate section 72 and integral therewith is lip 76, which contacts the more inboard one of side walls 58. On the opposite side of section 72 from lip 76 is dog leg section 78, which is also integral with section 72. Along dog leg section 78 is bracket flange 80, which intrudes between a lower portion 84 of conventional elastomeric gasket 82 and window pane 16 such that portion 84 is compressed. In known fashion, gasket 82 seats in window frame channel 88 of vehicle window frame 86, and frame 86 borders the sides and top of pane 16 when the pane is raised to its highest position. Bracket 70 is positioned relative to frame 86 and is configured so that flange 80 is in surface contact with pane 16 when flange 80 is between pane 16 and lower gasket portion 84.

The engagement of bracket 70 with frame 86 prevents window armor component 12 from swinging inboard and outboard of the vehicle on flange 46 when the vehicle travels and when door 14 is opened or closed. Consequently, armor structure 10 as a whole is more positively held on door 14 and does not rattle. Also, since window armor component 12 typically weighs 35 to 70 pounds and frame 48 weighs about 5 pounds, the combined swinging momentum of component 12 and frame 48 could conceivably damage pane 16 or door frame 86. By preventing the aforementioned swinging momentum, bracket 70 prevents the risk of damage to frame 48 and pane 16.

We ballistically tested armor structure 10 without bracket 70 and we found that window armor component 12 will swing inboard under the impact of projectiles striking the upper portion of that component. The inboard swing occurs mainly because flange 48 flexes as component 12 is struck by projectiles. For example, projectiles weighing 147 grains travelling at 2800 feet per second striking at point 90 (FIGS. 1 and 4), will swing the upper part of component 12 inboard by as much as 4 or 5 inches. When armor component 12 swings inboard, a vertical gap is momentarily created between the top of armor component 12 and the upper, horizontal segment 92 (FIG. 4) of frame 86. Spall caused by the projectiles' impact flies through the vertical gap into the passenger compartment of the vehicle. Bracket 70 prevents the inboard swing of armor component 12 and thus prevents spall's entry into the passenger compartment.

Referring to FIG. 2, we prefer the vertical dimensions of dog-leg section 78 and lip 76 to be minimized to reduce the silhouette, or visual profile, of bracket 70 as viewed in a horizontal direction from outside the vehicle. For the same reason, we desire that section 72 be oriented as horizontally as possible, preferably forming an angle of 30 degrees or less with a horizontal plane. Further, it is preferred that bracket 70 be shorter in length than top section 92 (FIG. 3) of frame 48.

We do not desire to be limited to the exact details of construction or method shown herein since obvious modifications will occur to those skilled in the relevant arts without departing from the spirit and scope of the following claims.

What is claimed is:

1. A low visibility interior armor construction for a door of an automotive vehicle wherein the structure is removably installed in the vehicle without permanent structural change thereto, the construction comprising:

a door window frame on the door, the window frame defining a window frame channel;

a gasket in the window frame channel, the gasket having a gasket portion at an opening of the window frame channel;

a window pane in the door having one position where the pane fills the door window frame and engages the gasket;

a door panel armor component facing an inboard side of the door;

means to connect the door armor panel component to the door;

a plate of clear window armor disposed alongside the door window frame;

a transparent frame comprised of a channel about and along a peripheral edge of the plate;

continuous polygonal bands forming side walls of the channel;

a bed placed between the polygonal bands such that the transparent frame defines a seamless surface facing outboard of the vehicle;

a bracket affixed on the transparent frame; and a flange of the bracket intruding between the gasket portion and the window pane.

2. The construction of claim 1 wherein the bracket has a section that is flat and is oriented at an angle of no more than 30 degrees with respect to a horizontal plane; and the bracket has a length less than that of a top section of the transparent frame;

so that visibility of the bracket is minimized from points of view outside the vehicle.

3. A low visibility interior armor construction for an automotive vehicle panel wherein the structure is installed in the vehicle without permanent structural change to the vehicle, the construction comprising:

a window frame on the vehicle panel, the window frame defining a window frame channel;

a window translatable engaged to the channel;

a panel armor component at an inboard side of the panel;

a plate of window armor disposed opposite the window frame;

a transparent frame containing the plate of window armor, the transparent frame having a single, seamlessly continuous surface faced outboard of the vehicle; a bracket affixed on the transparent frame; and a flange of the bracket protruding into the window frame channel and providing the sole, facial contact between the bracket and the window pane.

4. The construction of claim 3 further comprising:

a transparent flange fixed to a base of the transparent frame, the transparent flange forming an obtuse angle with the transparent frame; and means for securing the transparent flange to panel armor component.

5. The construction of claim 4 wherein the transparent flange is a flexible member defining a series of downward open slots and wherein the securing means passes through the slots.

6. The construction of claim 3 wherein the transparent frame includes two unapertured transparent sheets sandwiching the plate of window armor therebetween and wherein the sheets and bed elements encapsulate the sheet of window armor.

7. A low visibility interior armor construction for a door of an enclosed structure wherein the construction is removably installed on the door without permanent structural change to the door, the construction comprising:

a door window frame on the door, the window frame defining a window frame channel;

a window pane in the door having a position where the pane fills the door window frame;

a flat door panel armor component facing an inboard side of the door;

a flat plate of clear window armor disposed alongside the door window frame;

a transparent frame comprised of a channel about an edge of the plate;

continuous, polygonal bands forming side walls of the channel;

a bed placed between the polygonal bands such that the transparent frame defines a seamless, continuous surface facing outboard of the vehicle; and means for holding the frames together;

means for reducing the visibility of the holding means from points outside the vehicle.

* * * * *